United States Patent [19]

Auerbach

[11] Patent Number: 4,852,334

[45] Date of Patent: Aug. 1, 1989

[54] ENVELOPE OPENING APPARATUS

[75] Inventor: David R. Auerbach, West Redding, Conn.

[73] Assignee: Pitney Bowes Inc., Stamford, Conn.

[21] Appl. No.: 242,566

[22] Filed: Sep. 12, 1988

[51] Int. Cl.[4] ..... B65B 43/28; B65B 43/34

[52] U.S. Cl. ..... 53/569; 53/266 A

[58] Field of Search ..... 53/266 A, 376, 381 R, 53/382, 384, 569, 570

[56] References Cited

U.S. PATENT DOCUMENTS

| | | | |
|---|---|---|---|
| 1,754,831 | 4/1930 | Marsh | 53/569 |
| 3,886,715 | 6/1975 | Dorer | 53/569 X |
| 4,205,506 | 6/1980 | Moens et al. | 53/384 X |
| 4,253,292 | 3/1981 | Lipes | 53/384 X |
| 4,337,609 | 7/1982 | Foster et al. | 53/569 |
| 4,674,258 | 6/1987 | Ehlscheid et al. | 53/569 X |

*Primary Examiner*—Horace M. Culver

*Attorney, Agent, or Firm*—Lawrence E. Sklar; David E. Pitchenik; Melvin J. Scolnick

[57] ABSTRACT

Apparatus for separating the front and back walls of an envelope. The apparatus includes a supporting frame; a device mounted on the supporting frame for holding an envelope having a back wall, a front wall, and a flap extending from the back wall but not contiguous with the back wall; and an orbital claw assembly mounted in the supporting frame. The claw assembly includes a claw movable in an orbit which positions the tip of the claw at an appropriate time between the front and back walls of the envelope and thereafter further movement of the claw in the orbit causes the claw to separate the front wall from the back wall of the envelope.

5 Claims, 7 Drawing Sheets

ENVELOPE OPENING APPARATUS

BACKGROUND OF THE INVENTION

The instant invention relates to apparatus for inserting sheet materials into envelopes, and more particularly to a device for opening an envelope having orbital stripper claws but lacking any depressing fingers.

Envelope stuffing machines, such as those shown in U.S. Pat. Nos. 4,169,341 and 4,337,609, both assigned to the assignee of the instant application, generally include: a conventional structure for delivering an envelope, with its address panel oriented upwardly and its flap opened, to a registration gate at an enclosure inserting station; conventional structure for timely opening the delivered envelope, including a plurality of fingers known in the art as stripper fingers, which are insertable into the throat of the envelope for opening the same; and conventional structure for inserting an enclosure into the opened envelope. Typically, the envelope opening structure includes a plate which acts as a ledge upon which the flap of the envelope is located when it is delivered to the inserting station. Moreover, one or more rigid finger members, known in the art as depressor fingers, are fixedly attached to the framework of the inserter apparatus and disposed in overhanging relationship with respect to the envelope's address panel, for depressing the body of the envelope downwardly against the resistance afforded by the envelope flap ledge to thereby partially open the throat of the envelope to facilitate insertion of the stripper fingers into the envelope.

Operators of the conventional inserters have experienced difficulties with them due to the aforesaid fixed depressor fingers tending to prevent delivery of the envelope to the registration gate. As a result, many operators have been bending the depressor fingers away from the path travel of the envelope to ensure delivery to the registration gate, as a result of which the force exerted on the envelope by the depressor fingers is reduced and the envelope is insufficiently depressed to permit entry of the stripper fingers into the envelope for opening the same. Accordingly, misfeeds resulting from improper envelope registration and failure to open the envelopes have been found to be directly attributable to the provision of the fixed depressor fingers. The aforesaid U.S. Pat. No. 4,337,609 taught a partial solution to the problems generated by fixed depressor fingers by providing movable depressor fingers which normally hold the depressor fingers out of the path of travel of the envelope and for moving the depressor fingers into engagement with the envelope when a connective solenoid is enabled.

However, experience has shown that problems still persist using the movable depressor fingers. Accordingly, the instant invention provides an envelope opening apparatus which employs only a pair of orbital stripper claws and does not require the use of any depressor fingers, fixed or movable, and the substantial amount of apparatus associated therewith.

SUMMARY OF INVENTION

In accordance with the instant invention, there is provided apparatus for separating the front and back walls of an envelope, comprising: a supporting frame; means mounted on said supporting frame for holding an envelope having a back wall, a front wall, and a flap extending from said back wall, said flap not being contiguous with said back wall; and an orbital claw assembly mounted in said supporting frame. The assembly includes a claw movable in an orbit which positions the tip of the claw at an appropriate time between the front and back walls of said envelope and thereafter further movement of said claw in said orbit causes said claw to separate the front wall from the back wall of the envelope.

DESCRIPTION OF THE PREFERRED EMBODIMENT

Figure 1:
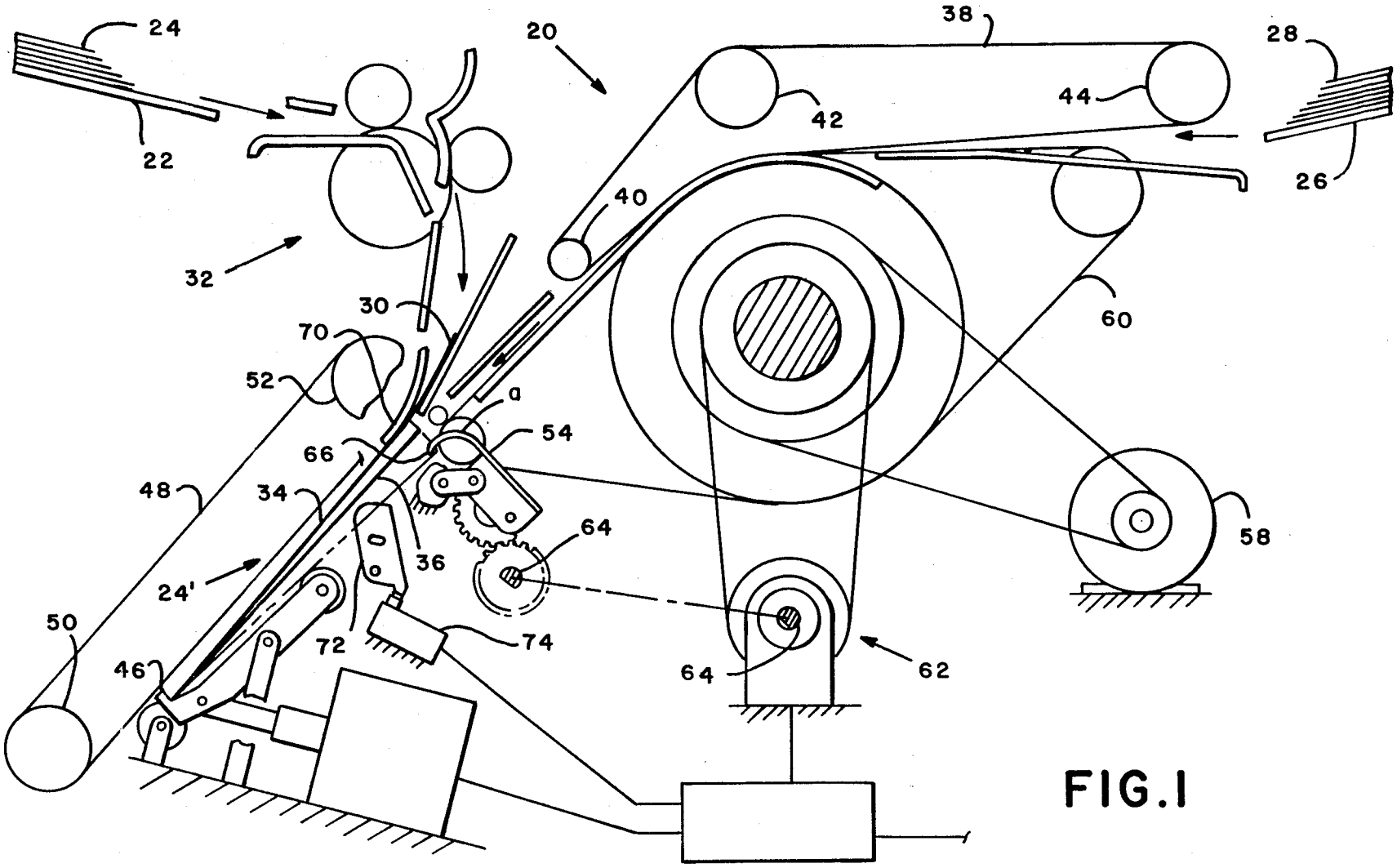
FIG. 1 is a side elevational, schematic view of envelope opening and inserting apparatus having envelope opening claw assemblies in accordance with the instant invention.
Figure 2:
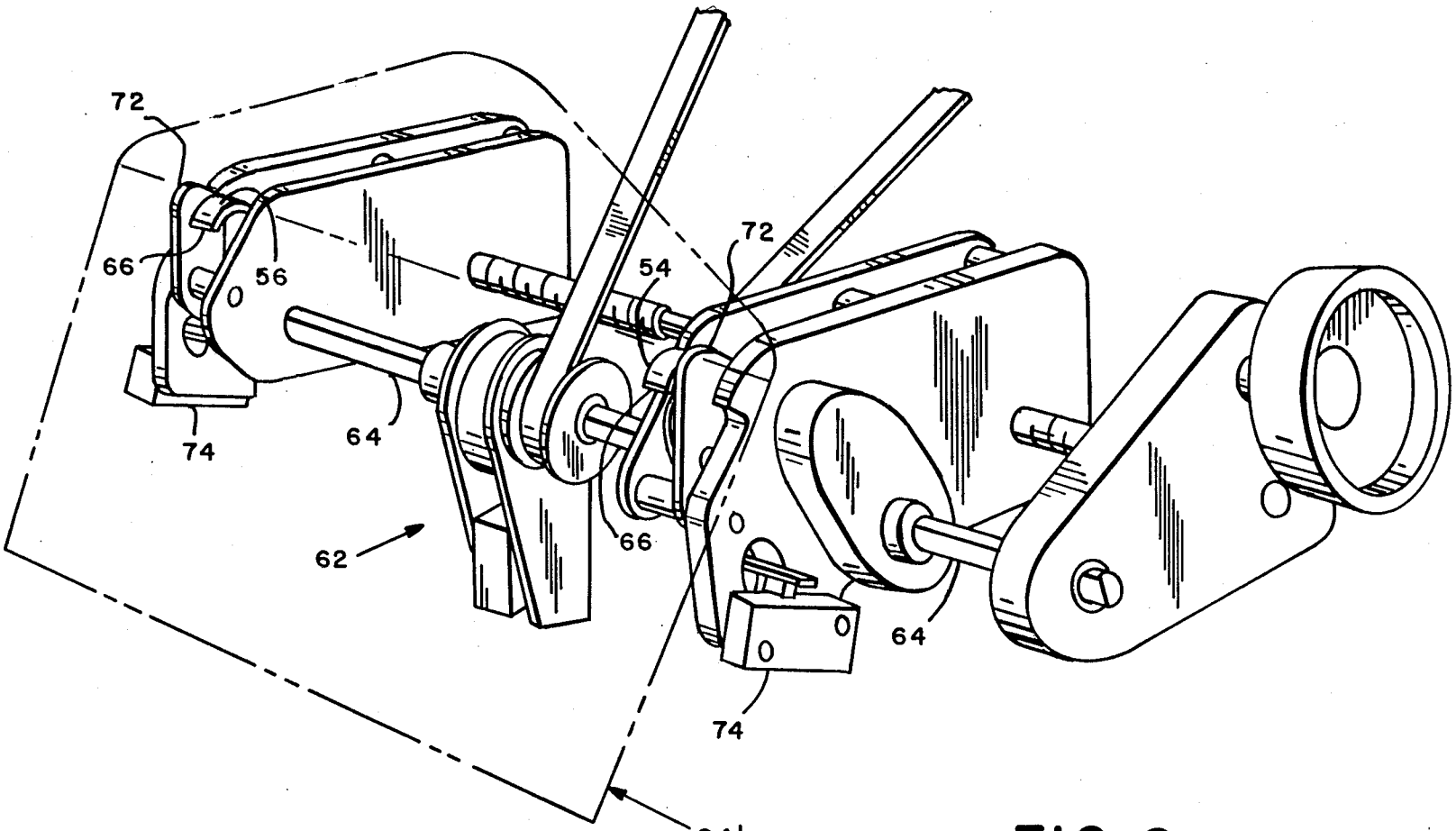
FIG. 2 is a perspective view of the drive apparatus and claw assemblies for the envelope opening device seen in FIG. 1.
Figure 3:
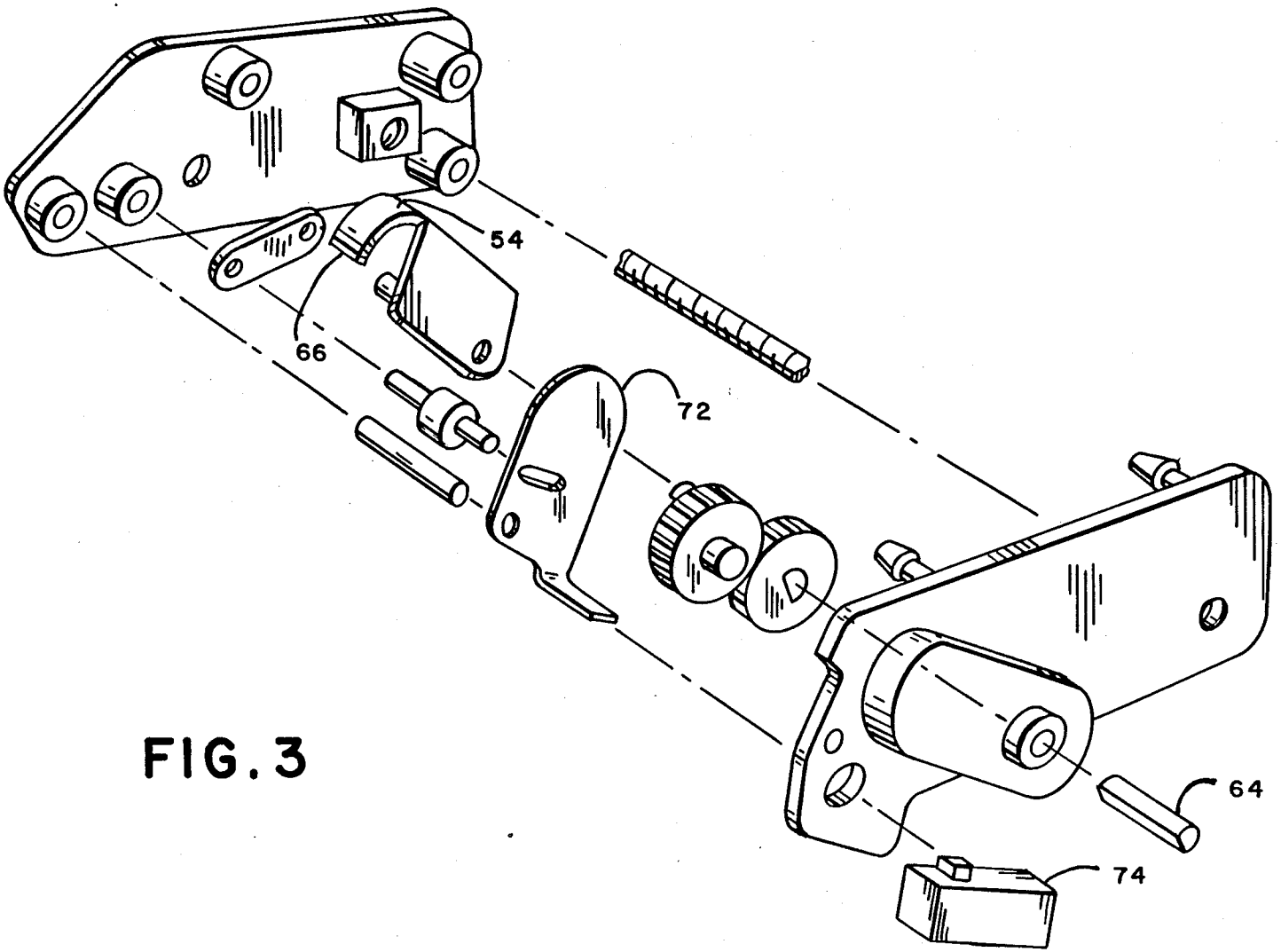
FIG. 3 is an exploded, perspective view of one of the two claw assemblies seen in FIG. 2.
Figure 4:
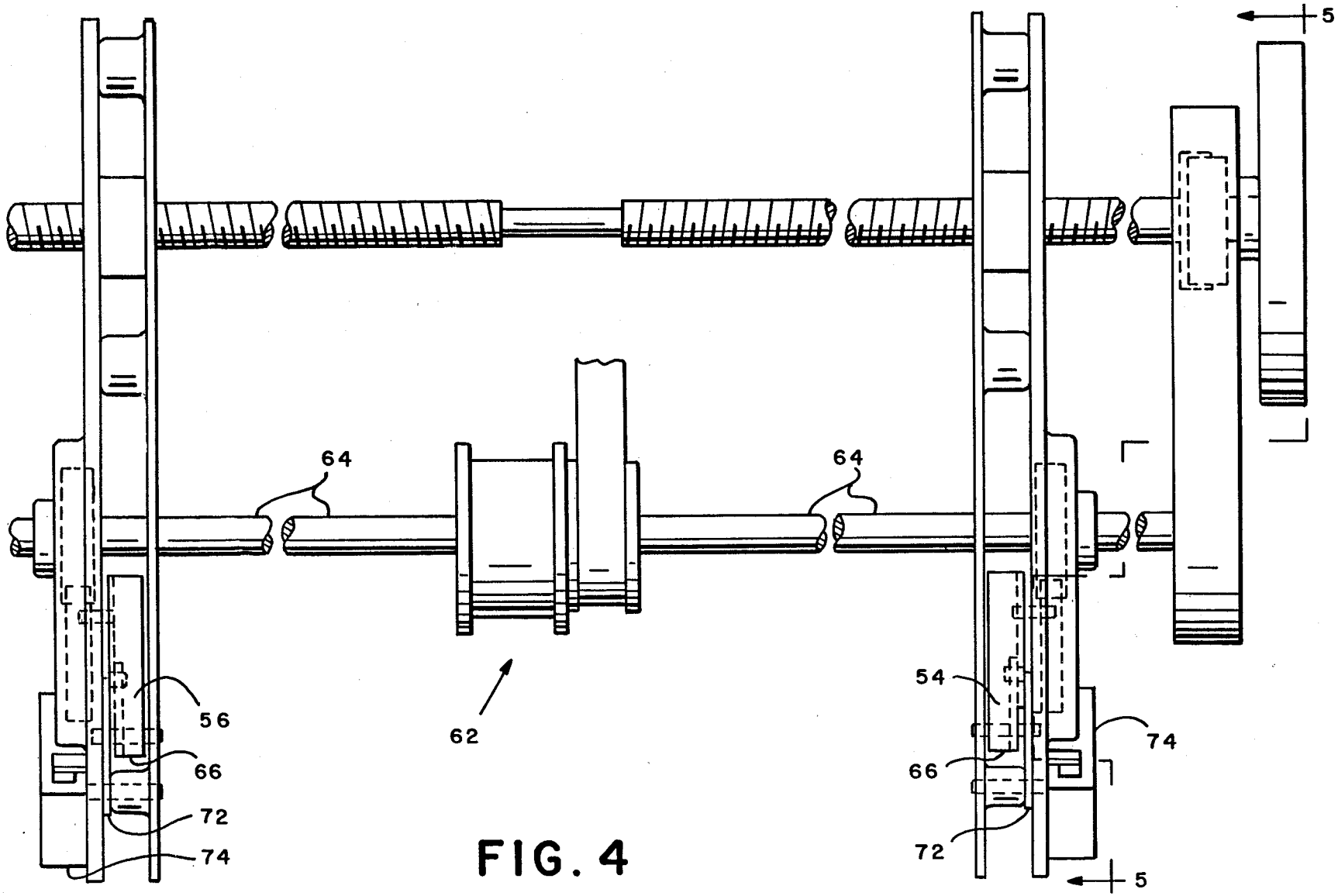
FIG. 4 is a top, plan view of the drive apparatus seen in FIG. 2.
Figure 5:
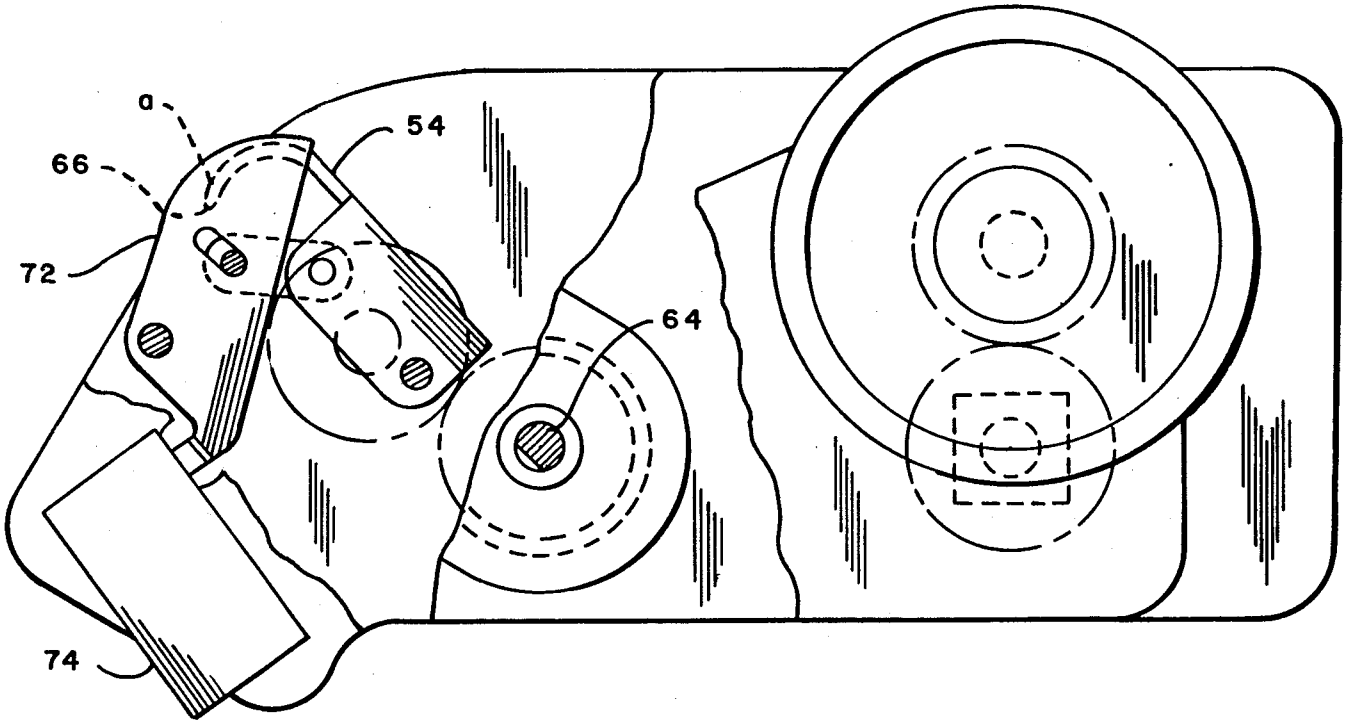
FIG. 5 is a sectional view taken on the plane indicated by the line 5—5 in FIG. 4.

In describing the preferred embodiment of the instant invention, reference is made to the drawings, wherein there is seen in FIG. 1 an envelope inserting apparatus generally designated 20 which includes a storage bin 22 for a stack of envelopes 24 and a hopper 26 for storing a plurality of inserts 28.

The envelopes 24 include the usual flap 30 which is bent or folded back on the envelope 24 when the envelope 24 is in the storage bin 22. Accordingly, an envelope flap stripper generally designated 32, which is well known in the art and does not require further explanation, is provided in order to separate the flap 30 from the long wall 34 and short wall 36 of the envelope 24' so that the envelope 24' can assume the open position seen in FIGS. 1 and 6-8 preparatory to receiving an insert 28. An upper belt 38 trained over pulleys 40, 42 and 44 is utilized for transporting the inserts 28 from the hopper 26 to the envelope 24' for insertion therein. Conventional feeding mechanisms (not shown) are utilized for separating and feeding the inserts 28 seriatim from the hopper 26 to the belt 38.

The envelope 24' is conveyed from the flap stripper 32 to a pivotable stop 46 by means of a belt 48 which is trained over a pair of pulleys 50 and 52. Thereafter, a pair of orbital, arcuate claws 54 and 56, whose function will be explained in greater detail hereinafter, are enabled to engage the envelope 24' and thereby open the envelope 24' to receive the insert 28.

The power for moving the claws 54 and 56 originates in a motor 58 and is transmitted to the lower belt 60, which in combination with the upper belt 38 controls the feeding of the inserts 28. The lower belt 60 engages the input end of a one cycle clutch 62. The upper belt 38 and the lower belt 60 and the motor 58 are constantly running. Passing through the one cycle clutch 62 is a "D" shaft 64 which functions to provide the power for both of the claws 54 and 56 when the clutch 62 is cycled and to provide a guide for the claws 54 and 56 as they are adjusted in and out for different sized envelopes.

Figure 6:
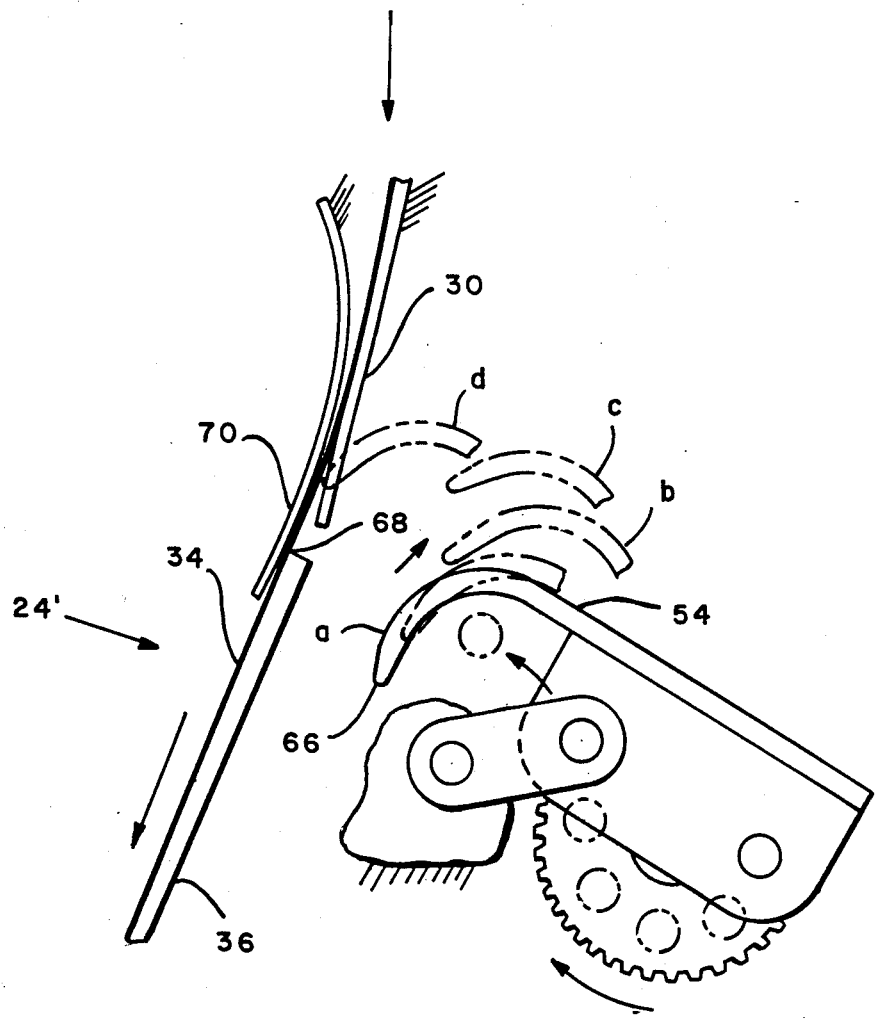
FIG. 6 is a side, elevational view of the envelope opening apparatus seen in FIG. 1 and shows an envelope about to be engaged and opened by the claw of the opening apparatus.

The path of the tips 66 of the claws 54 and 56 with the linkage shown in the drawings (see FIGS. 5–8) is a D shape. The linkage is oriented so that the vertical part of the "D" is substantially perpendicular to the insert path (i.e. the transport direction defined by the belt 48). Referring now to FIG. 6, after the one cycle clutch 62 has been activated, the claws 54 and 56 start from home position a and start to move through their orbit, passing through the positions shown as b, c and d. This arc takes the tips 66 of the claws 54 and 56 well above the flap fold line 68 which is situated above the throat of the envelope 24. A pair of light, flexible springs 70 positioned over the claws 54 and 56 respectively insure that the envelope 24' will be in the path of the claws tips 66 when the tips 66 assume the position seen in FIG. 7. When the claws 54 and 56 are between the positions d seen in FIG. 6 and that seen in FIG. 7, the claws 54 and 56 will push against the inside of the envelope flap 30 and the springs 70 will deflect, holding the envelope 24' against the claws 54 and 56 as the claws proceed to the position seen in FIG. 7 where the claws 54 and 56 start their downward motion into the throat of the envelope 24', thereby initiating engagement with the envelope 24'.

Figure 8:
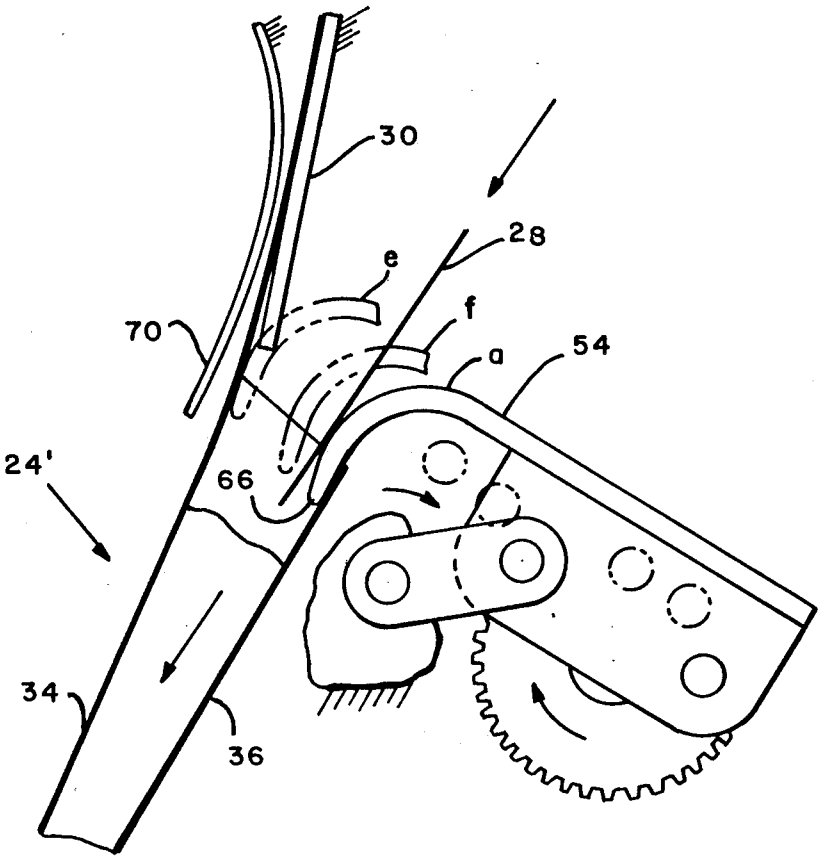
FIG. 8 is similar to FIG. 7 and shows the succeeding positions of the claw as it continues to engage and fully open the envelope prior to insertion of documents.
Figure 7:
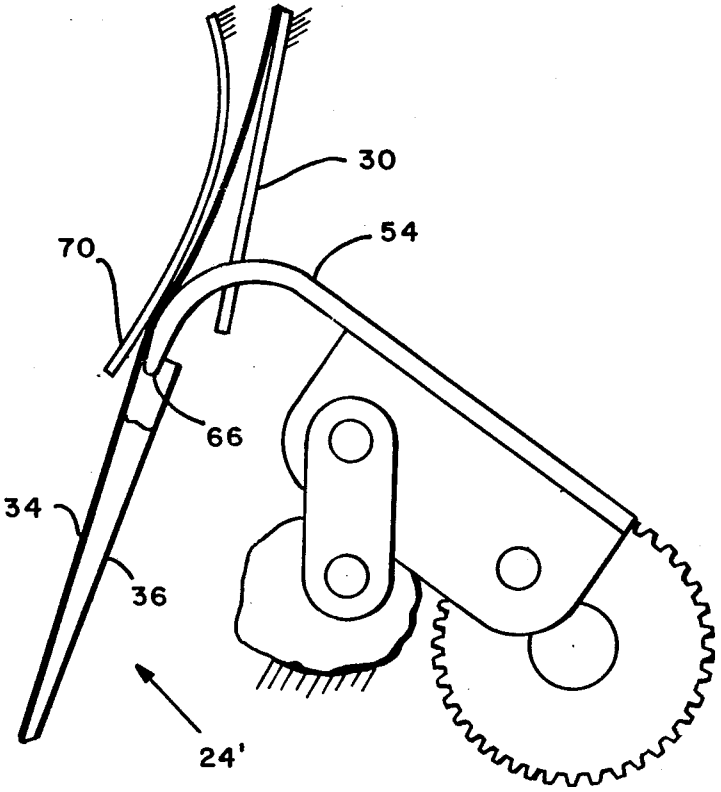
FIG. 7 is similar to FIG. 6 except that the claw is just beginning to engage and open the envelope.

After the envelope 24' has been engaged as described hereinabove, the claws 54 and 56 continue their orbit and start their trip back to the home position a through positions e and f, as illustrated in FIG. 8, which causes the envelope 24' to be opened.

Adjacent the claws 54 and 56 is the envelope opening sensing blade 72 which is positioned in such a way that, when the envelope 24' is pulled open as the claws 54 and 56 return to their home position a, the blade 72 moves with the envelope 24', opening the contacts in a micro-switch 74 and thereby indicating that the envelope 24' is open. If the claws 54 and 56 do not succeed in opening the envelope 24', the blade 72 will remain stationary when the claws 54 and 56 return to home position a, thus indicating to the software controlling the envelope inserting apparatus 20 that the opening has not been effected. Since an "envelope open" signal is required in order for the inserts 28 to be fed from the hopper 26, in the case of failure of an envelope 24' to be opened, an insert 28 would not be fed from the hopper 26. Because the claws 54 and 56 are very low in inertia and can operate at a very high speed, they can be cycled a number of times in order to effect the opening of the envelope 24' without a substantial loss of time in a normal inserting cycle.

It should be understood by those skilled in the art that various modifications may be made in the present invention without departing from the spirit and scope thereof, as described in the specification and defined in the appended claims.

What is claimed is:

1. Apparatus for separating the front and back walls of an envelope in a transport path, comprising:

a support frame;

means mounted on said supporting frame along said transport path for holding an envelope having a back wall, a front wall, and a flap extending from said back wall, said flap not being contiguous with said back wall; and an orbital claw assembly mounted in said supporting frame, said assembly including a claw movable in a D-shaped orbit wherein the vertical portion of the D-shaped orbit is substantially perpendicular to said transport path and wherein the orbit positions the tip of the claw at an appropriate time between the front and back walls of said envelope and thereafter further movement of said claw in said orbit causes saw claw to separate the front wall from the back wall of the envelope; and means mounted on said frame for generating said D-shaped orbit of said orbital claw assembly.

2. The apparatus of claim 1, additionally comprising belt means for feeding inserts to said envelope.

3. The apparatus of claim 2 additionally comprising belt means for conveying said envelope to said envelope holding means.

4. The apparatus of claim 3 wherein said envelope holding means includes a pivotable stop.

5. The apparatus of claim 4, wherein said claw is arcuate.

* * * * *